US005284552A

United States Patent [19]

Suzuki et al.

[11] Patent Number: 5,284,552

[45] Date of Patent: Feb. 8, 1994

[54] METHOD FOR REFINING METHYLNAPHTHALENE-CONTAINING OIL

[75] Inventors: Toshihide Suzuki; Yoshinori Takagi; Tatsuya Nobusawa, all of Chiba, Japan

[73] Assignee: Kawasaki Steel Corporation, Japan

[21] Appl. No.: 893,779

[22] Filed: Jun. 5, 1992

[30] Foreign Application Priority Data

Jun. 11, 1991 [JP] Japan ..... 3-139026
Mar. 13, 1992 [JP] Japan ..... 4-054817

[51] Int. Cl.[5] ..... B01D 3/36

[52] U.S. Cl. ..... 203/64; 203/91; 203/DIG. 16; 585/804; 585/841

[58] Field of Search ..... 203/64, 91, DIG. 16; 585/841, 804

[56] References Cited

U.S. PATENT DOCUMENTS

| | | | |
|---|---|---|---|
| 2,279,779 | 4/1942 | Engel | 203/64 |
| 2,358,128 | 9/1944 | Lake | 203/64 |
| 3,071,632 | 1/1963 | Schmid | 203/64 |
| 3,075,890 | 1/1963 | Chambers et al. | 203/64 |
| 3,171,794 | 3/1965 | Wynkoop et al. | 203/64 |
| 4,404,063 | 9/1983 | Honda | 203/6 |

FOREIGN PATENT DOCUMENTS

| | | |
|---|---|---|
| 1124958 | 10/1956 | France . |
| 0374336 | 3/1991 | Japan . |
| 943239 | 12/1963 | United Kingdom . |
| 2068409 | 8/1981 | United Kingdom . |

OTHER PUBLICATIONS

CAS 115 (16): 162865f, Fu, Yuan K. et al. 1887-91 (Eng) 1791.

CAS 115 (5): 491151g Haraoka, Takaji et al. Mar. 28, 1991.

CAS 108 (22): 1894782, Schimada, A. et al., 1988.

CAS 113 (24): 215000n, Sato, Toshio et al., 1990.

CAS 112 (23) 2164779, Sato, Nobuyuki et al., 1988.

CAS 105 (5) 4264g, Shiotani, et al., 1986.

CAS 97 (24): 200644c, Belsky Stephen et al. Sep. 14, 1982.

CAS 80 (3): 14752k, Watanabe, Tora et al. 1968.

Copy of European Search Report (3 pages).

*Primary Examiner*—Virginia Manoharan

*Attorney, Agent, or Firm*—Bierman and Muserlian

[57] ABSTRACT

A method for refining a methylnaphthalene-containing oil includes the steps of azeotropically distilling the methylnaphthalene-containing oil with ethylene glycol to produce a methylnaphthalene fraction having a reduced content of nitrogen compounds; and hydrodesulfurizing the methylnaphthalene fraction in the presence of a catalyst having loaded thereto at least one member selected from molybdenum, cobalt and nickel.

2 Claims, 1 Drawing Sheet

METHOD FOR REFINING METHYLNAPHTHALENE-CONTAINING OIL

BACKGROUND OF THE INVENTION

This invention relates to a method for refining a methylnaphthalene-containing oil which is capable of removing sulfur compounds contained in the oil. This invention also relates to a method for refining a methylnaphthalene-containing oil which is capable of removing nitrogen compounds contained in the oil together with the sulfur compounds.

Methylnaphthalene is useful as a solvent, dye carrier, heat medium and the like, and also, as a starting material for synthesizing vitamin $K_3$, and 2,6-naphthalenedicarboxylic acid, which is a starting material for various resins such as polyesters. In particular, methylnaphthalene having a low content of the sulfur compound is required for the production of vitamin $K_3$ and 2,6-naphthalenedicarboxylic acid.

Japanese Patent Application Kokai No. 3(1991)-74336 proposes an improved process for refining a methylnaphthalene-containing hydrocarbon oil wherein sulfur compounds are removed from the hydrocarbon oil by hydrodesulfurizing the hydrocarbon oil in the presence of a catalyst containing molybdenum and nickel or molybdenum and cobalt on an aluminum support under the conditions including a pressure of ordinary pressure to 9.9 kg/cm$^2$.

SUMMARY OF THE INVENTION

The process proposed in Japanese Patent Application Kokai No. 3(1991)-74336 is certainly better than other previous processes. However, this process still suffers from an insufficient desulfurization rate and a short life of the desulfurization catalyst used therefor.

The inventors of the present invention have made an intensive study and found out that i) a high content of nitrogen compounds in the methylnaphthalene oil results in a reduced desulfurization rate, ii) hydrogen pressure which has been increased for the purpose of improving the desulfurization rate results in a reduced methylnaphthalene recovery due to an increased rate of reduction with hydrogen of the aromatic ring in the methylnaphthalene, and (iii) a high content of nitrogen compounds in the methylnaphthalene oil results in a significantly shortened life of the desulfurization catalyst.

Accordingly, an object of the present invention is to solve the above-mentioned problems and to provide an industrially advantageous process for refining a methylnaphthalene-containing oil which may realize a high desulfurization rate as well as prolonged active life of the desulfurization catalyst.

According to the present invention, there is provided a method for refining a methylnaphthalene-containing oil comprising the steps of azeotropically distilling the methylnaphthalene-containing oil with ethylene glycol to produce a methylnaphthalene fraction having a reduced content of nitrogen compounds, and hydrodesulfurizing the methylnaphthalene fraction in the presence of a catalyst having at least one member selected from the group consisting of molybdenum, cobalt and nickel on a support.

Removal of the nitrogen compounds from methylnaphthalene oil has generally been carried out by chemical treatments such as sulfuric acid treating. Removal of the nitrogen compounds to a sufficient degree, however, has been quite difficult by such treatments. The inventors of the present invention have made an intensive study in order to sufficiently remove the nitrogen compounds from the methylnaphthalene-containing oil, and found out that, when ethylene glycol is added to the methylnaphthalene-containing oil to carry out an azeotropic distillation, and the resulting azeotrope is allowed to stand to thereby separate methylnaphthalene oil, content of the nitrogen compounds in the thus produced methylnaphthalene oil would be reduced to a degree sufficient for preventing the subsequent hydrodesulfurization from being adversely affected.

The inventors also found out that, even when the thus produced methylnaphthalene fraction is subjected to a hydrodesulfurization under moderate conditions, for example, at a pressure of ordinary pressure to 9.9 kg/cm$^2$·G, the methylnaphthalene fraction can still be desulfurized to a satisfactory degree with a prolonged active life of the desulfurization catalyst.

Consequently, a methylnaphthalene oil of a high purity having significantly reduced contents of sulfur compounds as well as nitrogen compounds could be produced at a high yield in an industrially advantageous process.

DETAILED DESCRIPTION OF THE INVENTION

Figure 1:
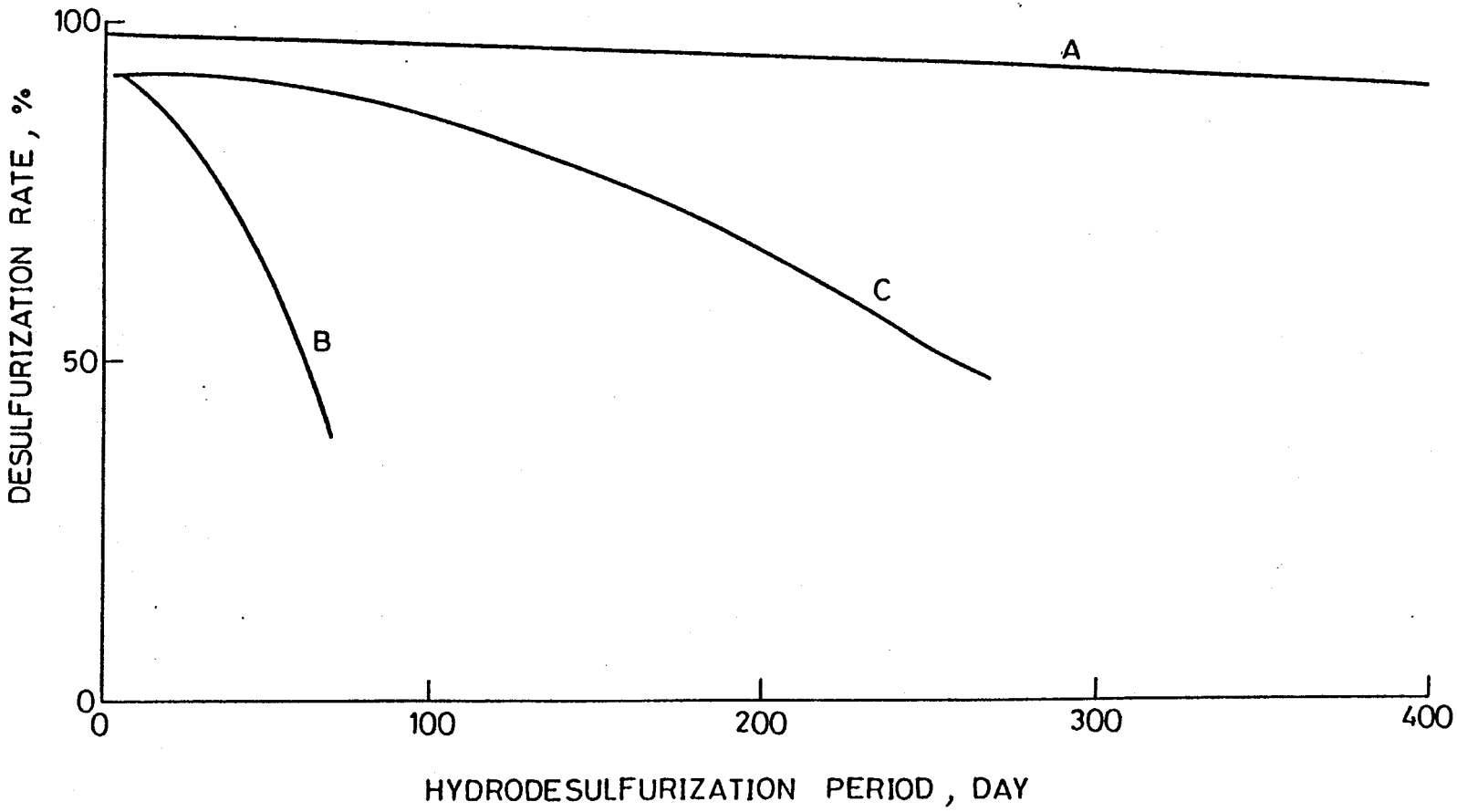
FIG. 1 diagrammatically illustrates the desulfurization rate in relation to period of the hydrodesulfurization operation.

The present invention is directed to a refinery of a methylnaphthalene-containing oil to produce methylnaphthalene with remarkably reduced sulfur and nitrogen contents.

The methylnaphthalene-containing oil which may be refined in the present invention may typically be a coal tar fraction containing the methylnaphthalene, and preferably, a coal tar fraction containing at least 10% by weight in total of 1-methylnaphthalene, 2-methylnaphthalene, and dimethylnaphthalene. Also, a methylnaphthalene oil produced in petroleum fractionation may of course be used.

The term "methylnaphthalene" used herein generally includes those which may be contained in hydrocarbon oils fractionated from petroleum, coal, and the like, which may be used as a starting material in the present invention. Typical species of the methylnaphthalene include 1-methylnaphthalene, 2-methylnaphthalene, and dimethylnaphthalene.

In the process of the present invention, the methylnaphthalene-containing oil is first subjected to azeotropic distillation with ethylene glycol added to the methylnaphthalene-containing oil to thereby obtain a methylnaphthalene fraction whose content of the nitrogen compounds is markedly reduced to 500 ppm or lower, and preferably to 100 ppm or lower calculated in terms of nitrogen atom.

The thus produced low-nitrogen methylnaphthalene fraction can be hydrodesulfurized to a high desulfurization degree even under moderate conditions of ordinary pressure to 9.9 kg/cm$^2$·G, and as a consequence of the moderate conditions, nucleus hydrogenation rate may be reduced to as low as 1% or lower. A methylnaphthalene oil having a low content of impurities is thereby produced at a high yield.

In addition, use of the low-nitrogen methylnaphthalene for the hydrodesulfurization also results in a prolonged active life of the hydrodesulfurization catalyst used for the hydrodesulfurization.

In the azeotropic distillation, ethylene glycol is added to the distillation tower. Composition of the azeotropic fraction is known, and is described, for example, in "6th advances in chemistry series", American Chemical Society, which discloses the composition of the azeotropic fraction under ordinary pressure. In the case of 2-methylnaphthalene, the composition of the azeotropic fraction is ethylene glycol/2-methylnaphthalene of 1.34 in molar ratio, and in the case of 1-methylnaphthalene, the composition of the azeotropic fraction is ethylene glycol/1-methylnaphthalene of 1.5 in molar ratio. The amount of the ethylene glycol added may be determined in consideration of such values.

More illustratively, when methylnaphthalene oil contains both 1-methylnaphthalene and 2-methylnaphthalene, the molar amount of the ethylene glycol required for obtaining the low-nitrogen methylnaphthalene at a high yield is sum of 1.5 times the molar amount of the 1-methylnaphthalene plus 1.34 times the molar amount of the 2-methylnaphthalene, or an amount slightly larger than such a sum. The amount of the ethylene glycol added to the distillation tower may be smaller than the above-mentioned amount, although the yield of the low-nitrogen methylnaphthalene would be somewhat reduced.

The azeotropic distillation may be carried out either by a continuous distillation or a batch distillation, and either at an ordinary pressure or at a reduced pressure.

Boiling point of each azeotrope and nitrogen compound at normal pressure is exemplified as follows.

| | |
|---|---|
| 1-methylnaphthalene (azeotrope) | 190° C. |
| 2-methylnaphthalene (azeotrope) | 190° C. |
| dimethylnaphthalene (azeotrope) | 193~195° C. |
| quinoline | 237° C. |
| isoquinoline | 243° C. |
| indole | 253° C. |

Therefore, the azeotrope is generally obtained from the top or near the top of the distillation tower. However, if desired, not only azeotropes of monomethylnaphthalenes may be obtained as the low-boiling-point fraction leaving the dimethylnaphthalene together with nitrogen compounds as the bottom fraction, but also each azeotrope of monomethylnaphthalenes and dimethylnaphthalenes may be separately obtained as the low-boiling-point fraction.

Each distillation process can be easily performed by the design of the distillation column and operation conditions thereof.

The azeotrope is then introduced into a tank to separate upper layer having low specific weight and to thereby obtain a methylnaphthalene fraction having a reduced content of the nitrogen compound, which preferably contains monomethylnaphthalenes and/or dimethylnaphthalenes.

In the azeotropic distillation, the nitrogen compound is generally recovered as a bottom fraction, and is removed from the methylnaphthalene oil.

As mentioned above, the nitrogen compound in the methylnaphthalene oil is generally reduced to 500 ppm or lower, and preferably 100 ppm or lower calculated in terms of nitrogen atom, so that the content of the nitrogen compound would generally be 1 to 500 ppm, and preferably 1 to 100 ppm.

Such a significant reduction of the nitrogen content may readily be carried out since vapor-liquid equibrium can be known for the nitrogen compound, the methylnaphthalene and the ethylene glycol so that number of theoretical stages and reflex ratio in the azeotropic distillation may easily be found out. The azeotropic distillation is generally carried out at a theoretical stage number of 1 to 100 and reflex ratio of 1 to 50.

After such a significant reduction of the nitrogen compounds contained in the methylnaphthalene oil as described above, the low-nitrogen methylnaphthalene fraction is subjected to a hydrogenation desulfurization or a hydrodesulfurization in the presence of a catalyst. The catalyst which may be used for the hydrodesulfurization is a catalyst having at least one member selected from molybdenum, cobalt, and nickel on a support, preferably on alumina. Preferable examples include cobalt-molybdenum/alumina, nickel-molybdenum-/alumina, cobalt-nickel-molybdenum/alumina, etc. A commercially available hydrodesulfurization catalyst may successfully be used. The catalyst may also have an additional element other than those mentioned above so long as the hydrodesulfurization efficiency is not adversely affected.

The hydrodesulfurization may be carried out at a temperature of 240° to 350° C., and preferably 260° to 320° C., and at a pressure of ordinary pressure to 9.9 $kg/cm^2 \cdot G$, and preferably at 1.0 to 6.0 $kg/cm^2 \cdot G$.

By using the temperature and the pressure within the above-mentioned ranges, the hydrodesulfurization of the methylnaphthalene can be promoted to a desired desulfurization degree and at a high yield.

In general, nucleus hydrogenation rate of the methylnaphthalene is increased in accordance with an increase in the desulfurization rate. In promoting the hydrodesulfurization to the required degree, it is recommended to select reaction conditions so as to minimize the nucleus hydrogenation rate. It can be noted that, by using the process of the present invention, methylnaphthalene oil may be desulfurized at a desulfurization rate of as high as 95% with a nucleus dehydrogenation rate of as low as 1% or lower.

The hydrodesulfurization may generally be carried out at a liquid hourly space velocity (LHSV, volume of the methylnaphthalene oil fed per 1 liter of the catalyst) of 0.1 to 10.0 $hr^{-1}$, and at a ratio of flow rate of the hydrogen in gas hourly space velocity (GHSV) to said LHSV, namely GHSV ($hr^{-1}$)/LHSV ($hr^{-1}$) of 30 or higher, preferably 50 to 300. A GHSV/LHSV ratio of less than 30 is likely to result in an insufficient desulfurization rate.

By the hydrodesulfurization as described above, the sulfur compounds are converted to those having lower boiling points, and therefore, may be separated by distillation to thereby obtain methylnaphthalene oil containing significantly reduced sulfur compounds.

The methylnaphthalene oil product of the process of the present invention has significantly reduced contents of the sulfur compounds as well as the nitrogen compounds, and therefore, may be advantageously employed as an intermediate for producing various compounds.

The present invention is described in further detail by referring to the following Examples which were performed to obtain purified monomethylnaphthalenes and do not limit the scope of the present invention.

EXAMPLES

EXAMPLE 1

To 100 parts by weight of absorption oil of coal tar fraction having the composition as shown in Table 1 was added 40 parts by weight of ethylene glycol. The mixture was subjected to batch distillation in a packed tower having 50 theoretical stages at a reflux ratio of 10 to obtain 29 parts by weight of methylnaphthalene fraction, which may be referred to as starting material A in the subsequent hydrodesulfurization. The methylnaphthalene fraction had a total content of 1-methylnaphthalene and 2-methylnaphthalene of 97.0% by weight, sulfur content of 0.58% by weight, and nitrogen content of 0.005% by weight. Recovery of 1-methylnaphthalene and 2-methylnaphthalene was 91%.

TABLE 1

| Composition of the absorption oil | |
|---|---|
| Constituent | % |
| naphthalene | 6.3 |
| 2-methylnaphthalene | 22.1 |
| 1-methylnaphthalene | 8.8 |
| quinoline | 4.5 |
| isoquinoline | 1.2 |
| diphenyl | 5.2 |
| dimethylnaphthalene | 6.9 |
| acenaphthene | 14.2 |
| indol | 2.2 |
| methylbenzothiophene | 2.1 |
| others | 26.5 |

Next, the thus denitrified methylnaphthalene fraction (starting material A) was subjected to hydrodesulfurization in a fixed-bed catalytic tubular flow reactor filled using a commercially available hydrodesulfurization catalyst which comprises γ-alumina support having loaded thereto 17% by weight of $MoO_3$ and 4.5% by weight of CoO under the conditions as shown in Table 2. Nucleus hydrogenation rate and desulfurization rate achieved by the hydrodesulfurization are also shown in Table 2. The thus desulfurized oil was distilled to produce methylnaphthalene oil having a purity of 99.0 to 99.5%.

The desulfurization rate was also monitored in a prolonged hydrodesulfurization operation using the starting material A by hydrodesulfurizing the starting material A at a reaction temperature of 330° C., a reaction pressure of 1 kg/cm$^2$·G, an LHSV of 1 hr$^{-1}$, and a GHSV of 100 hr$^{-1}$. The results are diagrammatically depicted in FIG. 1 (line A).

COMPARATIVE EXAMPLE 1

For comparison purpose, hydrodesulfurization was carried out using starting materials B and C.

Starting material B was a methylnaphthalene oil having a nitrogen content of 8,500 ppm, which had been prepared by distilling the absorption oil used in Example 1 with no ethylene glycol added thereto.

Starting material C was prepared by chemically washing the starting material B with aqueous sulfuric acid to remove the nitrogen-containing compounds such as quinoline, bubbling hydrochloric acid gas into the material to oligomerize indol contents, and removing the thus formed oligomer by filtration to thereby produce a material containing 600 ppm of nitrogen calculated in terms of nitrogen atom.

The thus prepared starting materials B and C were subjected to hydrodesulfurization in the presence of the same catalyst as Example 1 under the conditions shown in Table 2. The reaction conditions were selected so that the desulfurization rate would be substantially equivalent to those of Example 1. The results are also shown in Table 2

TABLE 2

| Starting material | | | Reaction conditions | | | | Desulfurization rate, % | Nucleus hydrogenation rate, % |
|---|---|---|---|---|---|---|---|---|
| Type | N content, ppm | S content, ppm | Temp., °C. | Pressure, kg/cm$^2$ · G | LHSV, hr$^{-1}$ | GHSV, hr$^{-1}$ | | |
| | | | | Example 1 | | | | |
| A | 50 | 5,800 | 300 | 2 | 1 | 100 | 92 | 0.9 |
| A | 50 | 5,800 | 280 | 2 | 0.5 | 100 | 96 | 0.7 |
| A | 50 | 5,800 | 330 | 1 | 1 | 100 | 98 | 0.4 |
| A | 50 | 5,800 | 260 | 5 | 0.5 | 120 | 90 | 0.8 |
| | | | | Comparative Example 1 | | | | |
| B | 8,500 | 6,500 | 360 | 20 | 0.5 | 200 | 92 | 8.8 |
| B | 8,500 | 6,500 | 400 | 20 | 1 | 200 | 94 | 12.5 |
| C | 600 | 6,000 | 330 | 6 | 1 | 120 | 92 | 2.4 |
| C | 600 | 6,000 | 320 | 8 | 1 | 100 | 95 | 3.5 |

LHSV: volume of starting oil fed per 1 liter of the catalyst
GHSV: volume of hydrogen fed per 1 liter of the catalyst
N content: concentration by weight
S content: concentration by weight The data in Table 2 reveal that the nucleus hydrogenation rate of the methylnaphthalene in Example 1 is as low as 1% or less while the nucleus hydrogenation rate in the Comparative Example was 2.4% to 12.5%.

The desulfurization rate was also monitored in a prolonged hydrodesulfurization operation using the starting materials B and C by hydrodesulfurizing the starting material B at a reaction temperature of 360° C., a reaction pressure of 20 kg/cm$^2$·G, an LHSV of 0.5 hr$^{-1}$, and a GHSV of 200 hr$^{-1}$, and by hydrodesulfurizing the starting material C at a reaction temperature of 330° C., a reaction pressure of 6 kg/cm$^2$·G, an LHSV of 1 hr$^{-1}$, and a GHSV of 120 hr$^{-1}$. The results are depicted in FIG. 1 (lines B and C).

FIG. 1 reveal that high desulfurization rate was maintained for a prolonged period in Example 1 wherein the starting material A was used, while the desulfurization rate was rapidly reduced in a relatively short period in Comparative Example 1 due to deterioration of the desulfurization catalyst. The processes of Comparative Example 1, therefore, are industrially disadvantageous compared to the process of the present invention.

EXAMPLES 2 TO 5

The hydrodesulfurization process of Example 1 was repeated by using the starting material A except that the hydrodesulfurization catalysts as shown in Table 3 were used, and the hydrodesulfurization was carried out at an LHSV of 1 $hr^{-1}$, a GHSV of 120 $hr^{-1}$, and under the reaction temperature and the pressure shown in Table 3.

TABLE 3

| Example number | Catalyst* composition weight, wt % | | | Reaction conditions | | Desulfurization rate, % | Nucleus hydrogenation rate, % |
|---|---|---|---|---|---|---|---|
| | $MoO_3$ | CoO | NiO | Pressure, $kg/cm^2 \cdot G$ | Temp., °C. | | |
| 2 | 14.0 | 3.8 | 0 | 3 | 310 | 93 | 0.5 |
| 3 | 8.0 | 2.5 | 0 | 6 | 330 | 95 | 0.8 |
| 4 | 10.0 | 0 | 2.6 | 4 | 320 | 92 | 0.6 |
| 5 | 10.5 | 1.2 | 0.7 | 4 | 320 | 90 | 0.5 |

*Each catalyst contains γ-alumina support

The data in Table 3 reveal that the nucleus hydrogenation rate of the methylnaphthalene in Examples 2 to 5 is as low as 0.5 to 0.8%.

We claim:

1. A method for refining methylnaphthalene-containing oil comprising the steps of azeotropically distilling the methylnaphthalene-containing oil with ethylene glycol to produce a methylnaphthalene fraction having not more than 500 ppm of nitrogen compounds selected from the group consisting of quinoline, isoquinoline and indole, and hydrodesulfurizing the methylnaphthalene fraction in the presence of a catalyst having at least one member selected from the group consisting of molybdenum, cobalt and nickel on a support at atmospheric pressure to a pressure of 9.9 $kg/cm^2G$.

2. The method according to claim 1 wherein the methylnaphthalene oil is a coal tar fraction.

* * * * *